US006116481A

United States Patent [19]

Arnold

[11] Patent Number: 6,116,481

[45] Date of Patent: Sep. 12, 2000

[54] HAT HANGER DEVICE

[76] Inventor: Dean Arnold, 7916 Tumbleweed Trail, Fort Worth, Tex. 76108

[21] Appl. No.: 09/484,464

[22] Filed: Jan. 14, 2000

[51] Int. Cl.[7] ..... A47G 25/14

[52] U.S. Cl. ..... 223/24; 223/1; 223/85

[58] Field of Search ..... 223/24, 25, 85, 223/1; 211/30, 31, 32, 33

[56] References Cited

U.S. PATENT DOCUMENTS

| | | | |
|---|---|---|---|
| 964,163 | 7/1910 | Kandlbinder | 223/85 |
| 2,631,734 | 3/1953 | Hartley | 223/24 |
| 2,786,615 | 3/1957 | Saibene | 223/85 |
| 5,033,660 | 7/1991 | Kelly | 223/85 |
| 5,169,007 | 12/1992 | McHendry | 211/32 |

*Primary Examiner*—Bibhu Mohanty

[57] ABSTRACT

A hat hanger device for safely storing a hat when not being worn. The hat hanger device includes includes a frame having a first elongate support member and a second elongate support member which is attached to the first elongate support member and has a second end portion which is spaced from and parallel to the first elongate support member, and further includes an arm member being pivotally and biasedly attached to a first end of the first elongate support member and having a padded member securely attached to a second end thereof, and also includes a ring member which is securely attached to a second end of the second elongate support member and is adapted to fit about the crown of a hat; and further includes a hook member which is pivotally secured in a coupling member which is also pivotally attached to the first elongate support member. In combination, the arm member and the ring member securely retains a hat to the hat hanger device.

12 Claims, 2 Drawing Sheets

HAT HANGER DEVICE

BACKGROUND OF THE INVENTION

1. Field of the Invention

The present invention relates to a support device for a hat and more particularly pertains to a new hat hanger device for safely storing a hat when not being worn.

2. Description of the Prior Art

The use of support device for a hat is known in the prior art. More specifically, support device for a hat heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,033,660; U.S. Pat. No. 2,720,984; U.S. Pat. No. 2,341,643; U.S. Pat. No. 5,169,007; U.S. Pat. No. 2,990,959; and U.S. Pat. No. Des. 346,700.

While these devices fulfill their respective, particular objectives and requirements, the aforementioned patents do not disclose a new hat hanger device. The inventive device includes a frame having a first elongate support member and a second elongate support member which is attached to the first elongate support member and has a second end portion which is spaced from and parallel to the first elongate support member, and further includes an arm member being pivotally and biasedly attached to a first end of the first elongate support member and having a padded member securely attached to a second end thereof, and also includes a ring member which is securely attached to a second end of the second elongate support member and is adapted to fit about the crown of a hat; and further includes a hook member which is pivotally secured in a coupling member which is also pivotally attached to the first elongate support member. In combination, the arm member and the ring member securely retains a hat to the hat hanger device.

In these respects, the hat hanger device according to the present invention substantially departs from the conventional concepts and designs of the prior art, and in so doing provides an apparatus primarily developed for the purpose of safely storing a hat when not being worn.

SUMMARY OF THE INVENTION

In view of the foregoing disadvantages inherent in the known types of support device for a hat now present in the prior art, the present invention provides a new hat hanger device construction wherein the same can be utilized for safely storing a hat when not being worn.

The general purpose of the present invention, which will be described subsequently in greater detail, is to provide a new hat hanger device which has many of the advantages of the support device for a hat mentioned heretofore and many novel features that result in a new hat hanger device which is not anticipated, rendered obvious, suggested, or even implied by any of the prior art support device for a hat, either alone or in any combination thereof.

To attain this, the present invention generally comprises includes a frame having a first elongate support member and a second elongate support member which is attached to the first elongate support member and has a second end portion which is spaced from and parallel to the first elongate support member, and further includes an arm member being pivotally and biasedly attached to a first end of the first elongate support member and having a padded member securely attached to a second end thereof, and also includes a ring member which is securely attached to a second end of the second elongate support member and is adapted to fit about the crown of a hat; and further includes a hook member which is pivotally secured in a coupling member which is also pivotally attached to the first elongate support member. In combination, the arm member and the ring member securely retains a hat to the hat hanger device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hat hanger device which has many of the advantages of the support device for a hat mentioned heretofore and many novel features that result in a new hat hanger device which is not anticipated, rendered obvious, suggested, or even implied by any of the prior art support device for a hat, either alone or in any combination thereof.

It is another object of the present invention to provide a new hat hanger device which may be easily and efficiently manufactured and marketed.

It is a further object of the present invention to provide a new hat hanger device which is of a durable and reliable construction.

An even further object of the present invention is to provide a new hat hanger device which is susceptible of a low cost of manufacture with regard to both materials and labor, and which accordingly is then susceptible of low prices of sale to the consuming public, thereby making such hat hanger device economically available to the buying public.

Still yet another object of the present invention is to provide a new hat hanger device which provides in the apparatuses and methods of the prior art some of the advantages thereof, while simultaneously overcoming some of the disadvantages normally associated therewith.

Still another object of the present invention is to provide a new hat hanger device for safely storing a hat when not being worn.

Yet another object of the present invention is to provide a new hat hanger device which includes includes a frame having a first elongate support member and a second elongate support member which is attached to the first elongate support member and has a second end portion which is spaced from and parallel to the first elongate support member, and further includes an arm member being pivotally and biasedly attached to a first end of the first elongate support member and having a padded member securely attached to a second end thereof, and also includes a ring member which is securely attached to a second end of the second elongate support member and is adapted to fit about the crown of a hat; and further includes a hook member which is pivotally secured in a coupling member which is also pivotally attached to the first elongate support member. In combination, the arm member and the ring member securely retains a hat to the hat hanger device.

Still yet another object of the present invention is to provide a new hat hanger device that essentially prevents a hat from being deformed or flattened.

Even still another object of the present invention is to provide a new hat hanger device that is easy to use and can be used almost anywhere and also saves the individual money and aggravation for having to otherwise reshape and recrease the hat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
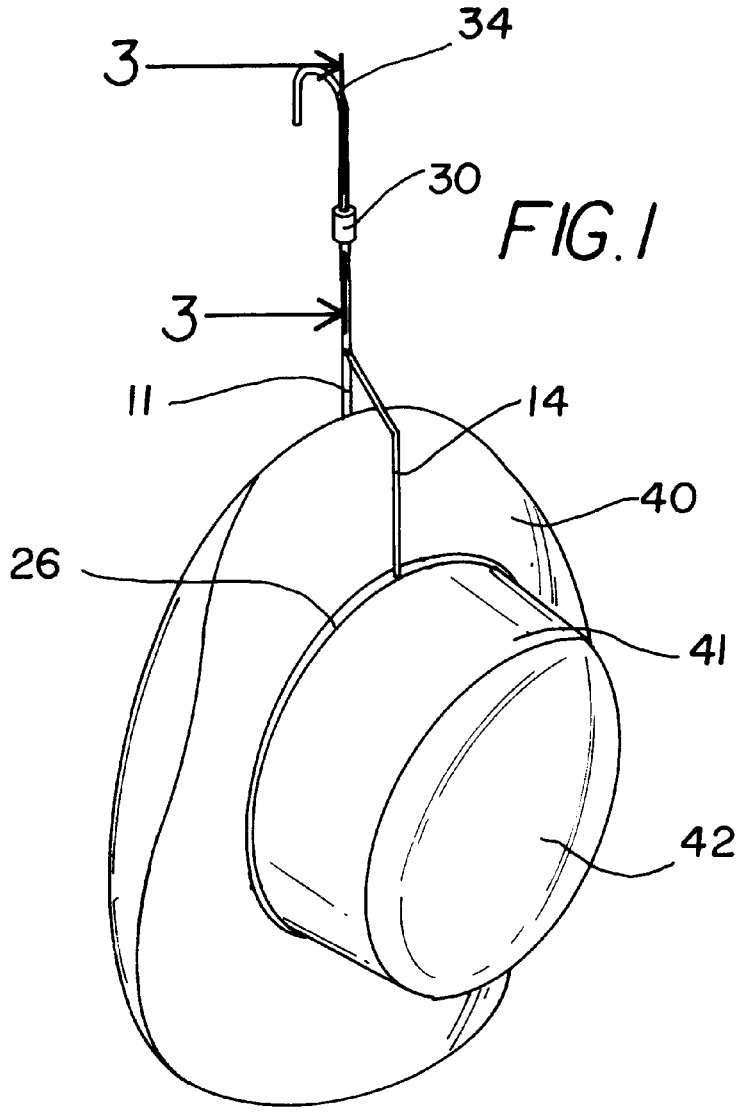
FIG. 1 is a perspective view of a new hat hanger device according to the present invention as shown in actual use.
Figure 2:
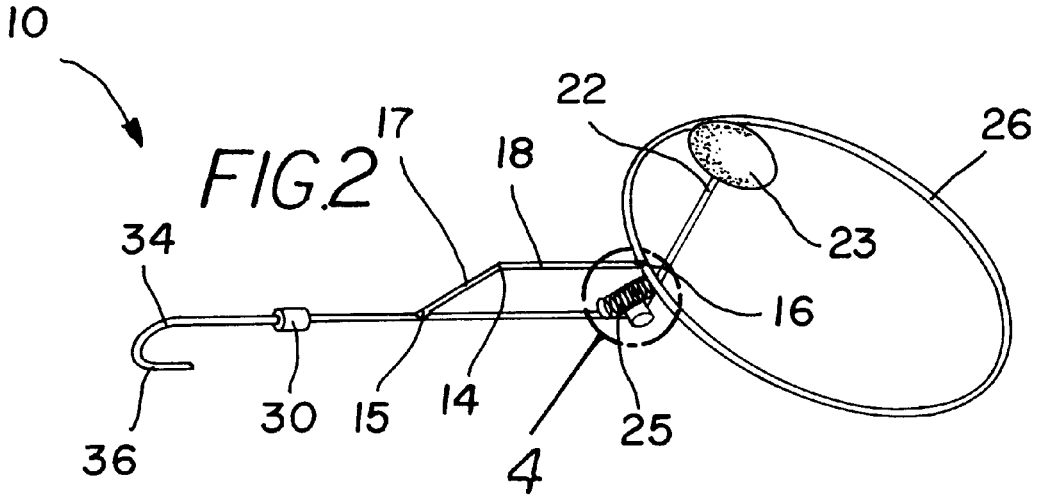
FIG. 2 is a perspective view of the present invention.
Figure 3:
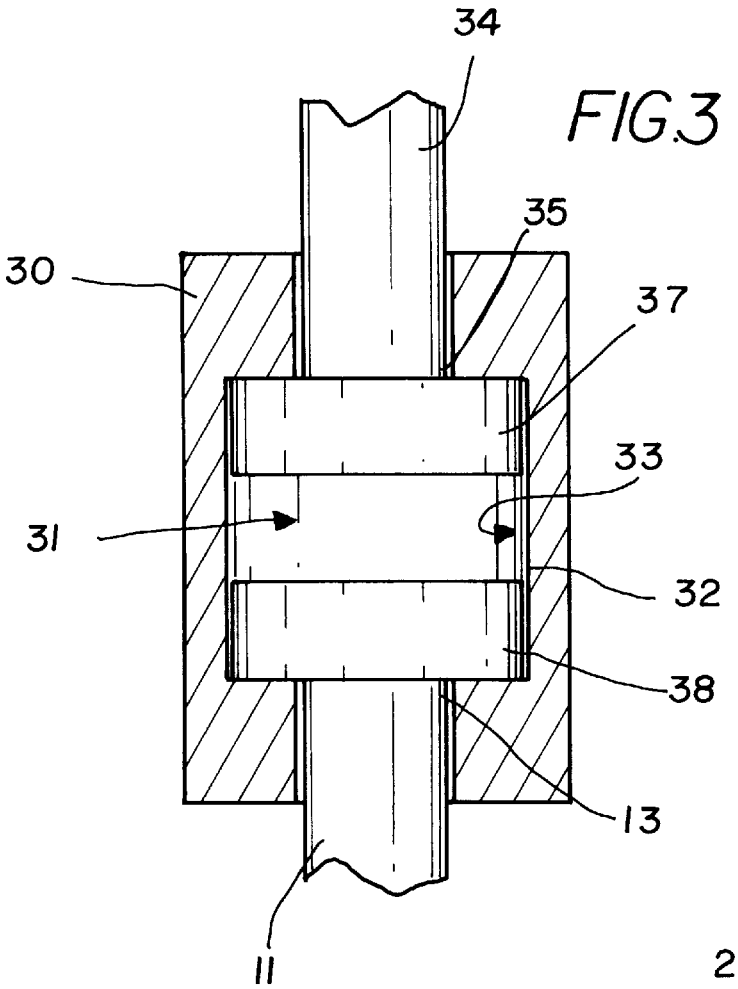
FIG. 3 is a detailed side cross-sectional view of the coupling member and flanges of the present invention.
Figure 4:
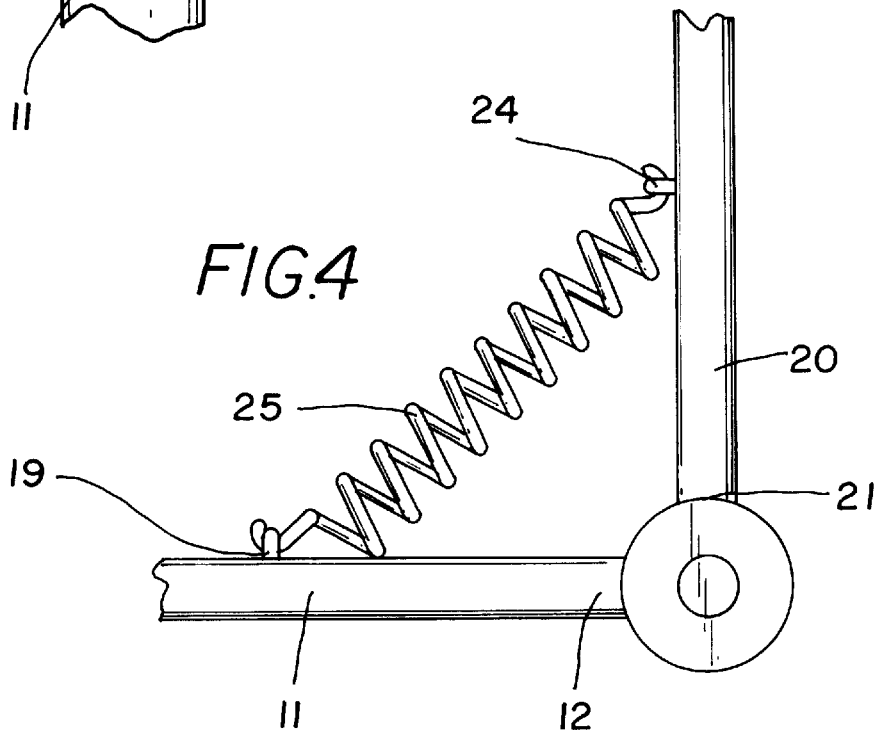
FIG. 4 is a detailed side elevational view of arm member being pivotally and biasedly attached to the first elongate support member of the present invention.

With reference now to the drawings, and in particular to FIGS. 1 through 4 thereof, a new hat hanger device embodying the principles and concepts of the present invention and generally designated by the reference numeral 10 will be described.

As best illustrated in FIGS. 1 through 4, the hat hanger device 10 generally comprises a frame having a first elongate support member 11 and a second elongate support member 14 with the first elongate support member 11 having a first end 12 and a second end 13. The second elongate support member 14 includes a second end 16, a first end 15, a second end portion 18, and a first end portion 17 angled relative to the second end portion 18. The first end 15 of the second elongate support member 14 is securely attached or welded or molded to an intermediate portion of the first elongate support member 11. The first end portion 17 is angled relative to the first elongate support member 11. The second end portion 18 is spaced from and parallel to the first elongate support member 11 with the second end 16 of the second elongate support member 14 being securely attached or welded or molded to the ring member 26. The hat hanger device 10 further includes an arm member 20 having a first end 21 and a second end 22 and being pivotally and biasedly attached to the first elongate support member 11, and further has a padded member 23 securely and conventionally attached to the second end 22 thereof. The first end 21 of the arm member 20 is pivotally attached to the first end 12 of the elongate support member 11. The arm member 20 includes an eyelet 24 which is securely attached or welded or molded to an intermediate portion thereof. The first elongate support member 11 also includes an eyelet 19 which is securely attached or welded or molded to an intermediate portion thereof. A spring member 25 is connected to the arm member 20 and to the elongate support member 11 for biasing the arm member 20 toward the first elongate support member 11. The spring member 25 has hook-like ends, each of the hook-like ends being removeably hooked to a respective one of the eyelets 19,24. A ring member 26 is securely attached or welded or molded to the second elongate support member 14 and is adapted to adapted to fit about and support a crown 41 of a hat 40. A coupling member 30 is pivotally attached to the second end 13 of the first elongate support member 11 with the coupling member 30 being essentially a cylindrical body having a first end and a second end and a bore 31 extending therethrough from the first end through the second end and having an interior wall 32 defining the bore with the interior wall having a recessed portion 33. A hook member 34 having a first end 35 and a curved end portion 36 is pivotally connected to the coupling member 30. The first end 35 of the hook member 34 includes a flange 37 which is pivotally extended through the first end of the coupling member 30 and is securely retained in the bore 31 and the recessed portion 33 of the coupling member 30. The second end 13 of the first elongate support member 11 includes a flange 38 which is pivotally extended through the second end of the coupling member 30 and is securely retained in the bore 31 and the recessed portion 33 of the coupling member 30.

In use, the user places the crown 41 of the hat 40 through the ring member 26 and places the padded member 23 inside the crown 41 of the hat 40 and against the interior of the top wall 42 of the crown 41 to prevent the hat 40 from coming off the hat hanger device 10. The spring member 25 will bias the arm member 20 and the padded member 23 against the top wall 42 of the crown 41 such that the hat 40 is securely retained basically between the ring member 26 and the arm member 20. With the hook member 34, the user can hang the hat hanger device 10 in the closet, in the car, and almost anywhere as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hat hanger device comprising:

a frame having a first elongate support member and a second elongate support member, said first elongate support member having a first end and a second end;

an arm member having a first end and a second end and being pivotally and biasedly attached to said first elongate support member, and further having a padded member securely attached to said second end thereof;

a spring member being connected to said arm member and to said elongate support member for biasing said arm member toward said first elongate support member;

a ring member being securely attached to said second elongate support member and being adapted to fit about and support a crown of a hat;

a coupling member being pivotally attached to said second end of said first elongate support member; and a hook member having a first end and a curved end portion and being pivotally connected to said coupling member.

2. A hat hanger device as described in claim 1, wherein said second elongate support member includes a second end, a first end, a second end portion, and a first end portion angled relative to said second end portion.

3. A hat hanger device as described in claim 2, wherein said first end of said second elongate support member is securely attached to an intermediate portion of said first elongate support member, said first end portion being angled relative to said first elongate support member, said second end portion being spaced from and parallel to said first elongate support member.

4. A hanger device as described in claim 3, wherein said second end of said second elongate support member is securely attached to said ring member.

5. A hanger device as described in claim 4, wherein said first end of said arm member is pivotally attached to said first end of said elongate support member.

6. A hanger device as described in claim 5, wherein said arm member includes an eyelet which is securely attached to an intermediate portion thereof, said first elongate support member also including an eyelet which is securely attached to an intermediate portion thereof.

7. A hanger device as described in claim 6, wherein said spring member has hook-like ends, each of said hook-like ends being removeably hooked to a respective one of said eyelets.

8. A hanger device as described in claim 7, wherein said coupling member is essentially a cylindrical body having a first end and a second end and a bore extending therethrough from said first end through said second end and having an interior wall defining said bore.

9. A hanger device as described in claim 8, wherein said interior wall of said bore has a recessed portion.

10. A hanger device as described in claim 9, wherein said first end of said hook member includes a flange which is pivotally extended through said first end of said coupling member and is securely retained in said bore and said recessed portion of said coupling member.

11. A hanger device as described in claim 10, wherein said second end of said first elongate support member includes a flange which is pivotally extended through said second end of said coupling member and is securely retained in said bore and said recessed portion of said coupling member.

12. A hat hanger device comprising:

A frame having a first elongate support member and a second elongate support member, said first elongate support member having a first end and a second end, said second elongate support member including a second end, a first end, a second end portion, and a first end portion angled relative to said second end portion, said first end of said second elongate support member being securely attached to an intermediate portion of said first elongate support member, said first end portion being angled relative to said first elongate support member, said second end portion being spaced from and parallel to said first elongate support member, said second end of said second elongate support member being securely attached to a ring member;

an arm member having a first end and a second end and being pivotally and biasedly attached to said first elongate support member, and further having a padded member securely attached to said second end thereof and being adapted to rest against a crown of a hat, said first end of said arm member being pivotally attached to said first end of said elongate support member, said arm member including an eyelet which is securely attached to an intermediate portion thereof, said first elongate support member also including an eyelet which is securely attached to an intermediate portion thereof;

a spring member being connected to said arm member and to said elongate support member for biasing said arm member toward said first elongate support member, said spring member having hook-like ends, each of said hook-like ends being removeably hooked to a respective one of said eyelets;

the ring member being securely attached to said second elongate support member and being adapted to fit about and support a crown of a hat and in combination with said arm member to essentially removeably retain a hat between said ring member and said arm member;

a coupling member being pivotally attached to said second end of said first elongate support member said coupling member being essentially a cylindrical body having a first end and a second end and a bore extending therethrough from said first end through said second end and having an interior wall defining said bore, said interior wall having a recessed portion; and a hook member having a first end and a curved end portion and being pivotally connected to said coupling member, said first end of said hook member including a flange which is pivotally extended through said first end of said coupling member and being securely retained in said bore and said recessed portion of said coupling member, said second end of said first elongate support member including a flange which is pivotally extended through said second end of said coupling member and being securely retained in said bore and recessed portion of said coupling member.

* * * * *